United States Patent [19]

Bobroff

[11] 4,300,760

[45] Nov. 17, 1981

[54] EXERCISE DEVICE

[76] Inventor: Harry Bobroff, c/o The Perfection Manufacturing Company, 4236 Clayton Ave., St. Louis, Mo. 63110

[21] Appl. No.: 758,566

[22] Filed: Jan. 12, 1977

[51] Int. Cl.[3] ..... A63B 21/00

[52] U.S. Cl. ..... 272/120

[58] Field of Search ..... 272/73, 72, 116, 120, 272/121, 134

[56] References Cited

U.S. PATENT DOCUMENTS 2,642,288 6/1953 Bell ..... 272/120

2,924,456 2/1960 Miller ..... 272/120

*Primary Examiner*—Richard C. Pinkham

*Assistant Examiner*—Arnold W. Kramer

*Attorney, Agent, or Firm*—Cohn, Powell & Hind

[57] ABSTRACT

An exercise device having a seat assembly that includes a seat, and a seat frame extending forwardly of the seat and connected to a frame assembly, and a seat-support arm pivotally mounted to the seat frame, the arm having attached at its lower end a follower that is movably engageable with a subjacent surface. A linkage is pivotally connected to a leg-actuated member pivotally connected to an upper front frame portion, and is pivotally connected to the seat-support arm. An arm-actuated member is pivotally connected to the linkage between the pivotal connections of the linkage with the leg-actuated member and the seat-support arm, and is pivotally related with the upper front frame portion. The arm-actuated member and the leg-actuated member are pulled and pushed respectively by the arms and legs of a user sitting on the seat to pivot the seat-support arm and to move the seat-support follower forwardly on the subjacent surface, and thereby raise the seat against the weight of the user, the user's weight tending to move the seat-support follower rearwardly on the subjacent surface and thereby lower the seat.

1 Claim, 4 Drawing Figures

EXERCISE DEVICE

BACKGROUND OF THE INVENTION

This invention relates generally to improvements in an exercise device, and more particularly to an improved device of this type that is operable by the user with both his arms and legs to raise and lower a seat against the resistance provided by the user's weight.

In heretofore conventional exercise devices, the user both pushed with the feet and pulled with the arms to raise a seat. However, these devices required complicated linkage assemblies and did not function in the same manner as the present exercise device.

SUMMARY OF THE INVENTION

With the present exercise device, the user sits on the seat and pushes on the foot-engaging members and pulls on the handgrip members at the same time. The linkage mechanism then raises the seat up as a wheel of a seat-support means rolls forwardly on a subjacent surface. The weight of the user causes resistance to the upward movement of the seat.

In this exercise device, a seat-support means is pivotally connected to a seat means and is movably engageable with a subjacent surface. A leg-actuated means is pivotally mounted to a frame means that is also connected to the seat means. Linkage means interconnects the leg-actuated means with the seat-support means. Pivotally connected to the linkage means and pivotally related with the frame means, is an arm-actuated means. The arm-actuated means and the leg-actuated means are pulled and pushed respectively to pivot the seat-support means and move the seat-support means on the subjacent surface, and thereby raise the seat means against the weight of the user on the seat means.

The seat-support means includes an arm and wheel means rollably engaging the subjacent surface. The frame means includes a floor-engaging portion and an upper frame portion forwardly of a seat. The leg-actuated means is pivoted to the upper frame portion and extends downwardly, the leg-actuated means including foot-engaging members. The seat-support arm extends downwardly and rearwardly from its pivotal connection to the seat means.

The simple linkage means is connected to the leg-actuated means below its pivotal connection to the upper frame portion, and is connected to the seat-support arm between its pivotal connection to the seat means and the wheel means.

The arm-actuated means is pivotally connected to the linkage means between the connections of the linkage means with the leg-actuated means and the seat-support arm, and extends upwardly for pivotal-related engagement with the upper frame portion.

In the present exercise device, the frame means includes a floor-engaging front portion, and an upper front portion. The seat means includes a seat rearwardly of the upper frame portion, and a seat frame extending forwardly of the seat and connected to the frame means. The seat support means includes an arm pivotally mounted to the seat frame, and extending downwardly and rearwardly, and includes a follower movably engageable with the subjacent surface. The leg-actuated means is pivotally connected to the upper front frame portion, and extends downwardly, the leg-actuated means including a pair of foot-engaging members. The linkage means is pivotally connected to the leg-actuated means and is pivotally connected to the seat-support arm. The arm-actuated means is pivotally connected to the linkage means between the pivotal connections of the linkage means with the leg-actuated means and the seat-support arm, and is pivotally related with the upper front frame portion. The arm-engaging means includes handgrip members. As the user pulls on the arm-actuated means and pushes on the leg-actuated means, the seat-support arm is pivoted and the follower moves forwardly on the subjacent surface, thereby raising the seat means against the weight of the user. The user's weight tends to move the seat-support follower rearwardly on the subjacent surface and thereby lowers the seat means.

In the particular embodiment of the invention, the frame means includes a track between the floor-engaging front and rear portions, the track providing the subjacent surface that is engageable by the seat-support follower.

DESCRIPTION OF THE PREFERRED EMBODIMENT

Figure 1:
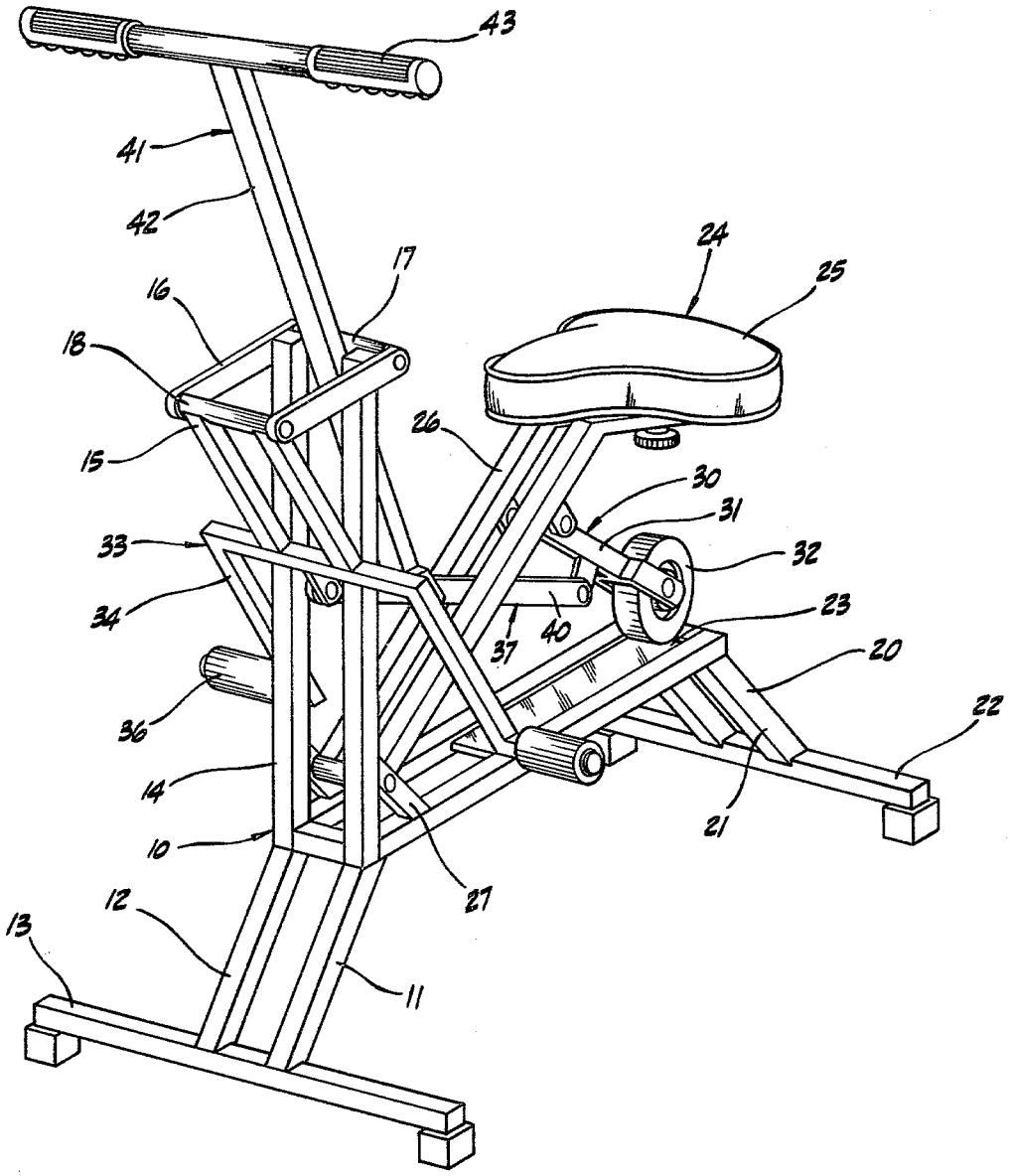
FIG. 1 is a perspective view of the exercise device.

Referring now by characters of reference to the drawings, the exercise device includes a frame means generally referred to by 10 that includes a floor-engaging front portion 11 consisting of a pair of spaced posts 12 and a transverse bar 13 adapted to seat on a subjacent surface such as a floor. The frame means 10 also includes an upper front portion 14 consisting of a pair of vertical, spaced posts 15, and a pair of forwardly extending, spaced bars 16. The spaced bars 16 are interconnected at the rear by a cross bar 17 and at its front by a cross bar 18.

In addition, the frame means 10 includes a floor-engaging rear portion 20 consisting of a pair of spaced posts 21 interconnected at their lower ends by a transverse bar 22 adapted to seat on a subjacent supporting surface such as a floor.

Located between the floor-engaging front portion 11 and the floor-engaging rear portion 20 is a track 23 that constitutes a subjacent surface, the purpose and function of which will be later described upon more detailed description of parts.

A seat means referred to by 24 includes a seat 25 rearwardly of the upper front frame portion 14 on which the user sits, and a seat frame 26 extending forwardly of the seat 25 for connection to the frame means 10. More particularly, the seat frame 26 is pivotally connected to braces 27 interconnecting the vertical posts 15 with the track 23.

A seat-support means generally indicated by 30 is pivotally connected to the seat means 24 and is movably engageable with a subjacent surface such as that provided by track 23. The seat-support means 30 includes an arm 31 pivotally mounted to the seat frame 26, and extending downwardly and rearwardly, and includes a follower such as a wheel 32 at the lower end of arm 31 which movably engages the track 23.

Pivotally mounted to the frame means 10 is a leg-actuated means referred to by 33 pivotally connected to the upper front frame portion 14. More particularly, the leg-actuated means 33 includes a bifurcated bracket 34 pivotally connected by spaced posts 35 to the cross bar 18, the bracket 34 extending downwardly and including a pair of foot-engaging members 36.

A linkage means indicated by 37 is pivotally connected to the leg-actuated means 33 and is pivotally connected to the seat-support means 30. This linkage means 37 includes an elongate bar 40 pivotally connected at one end to the center of the bracket 34 and pivotally connected at the other end to the seat-support arm 31.

An arm-actuated means referred to by 41 is pivotally connected to the linkage means 37 and is pivotally related with the upper front frame portion 14. More particularly, the arm-actuated means 41 includes a handle bar 42 pivoted at its lower end to the linkage bar 40 between the pivotal connections of the linkage bar 40 with the bracket 34 and the seat-support arm 31. The handle bar 42 engages the cross bar 17 in both pivot and slide bearing relation. The handle bar 42 is provided with handgrip members 43.

Figure 2:
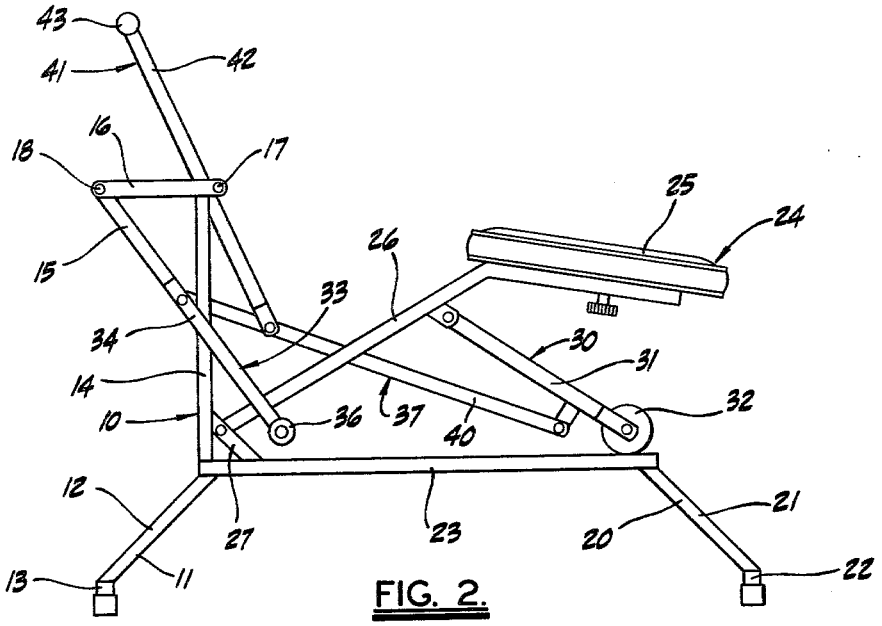
FIG. 2 is a side elevational view of the exercise device, showing the seat in its lowered position.

It is thought that the operation and usage of the exercise device has become apparent from the foregoing detailed description of parts, but for completeness of disclosure, the mode of operation and the functional results will be briefly described. It will be assumed that the user sits on the seat 25 with his feet on the foot-engaging members 36 and his hands gripping the handgrip members 43. In the initial position, the weight of the user maintains the seat 25 in its lowered position as is illustrated in FIG. 2.

Figure 3:
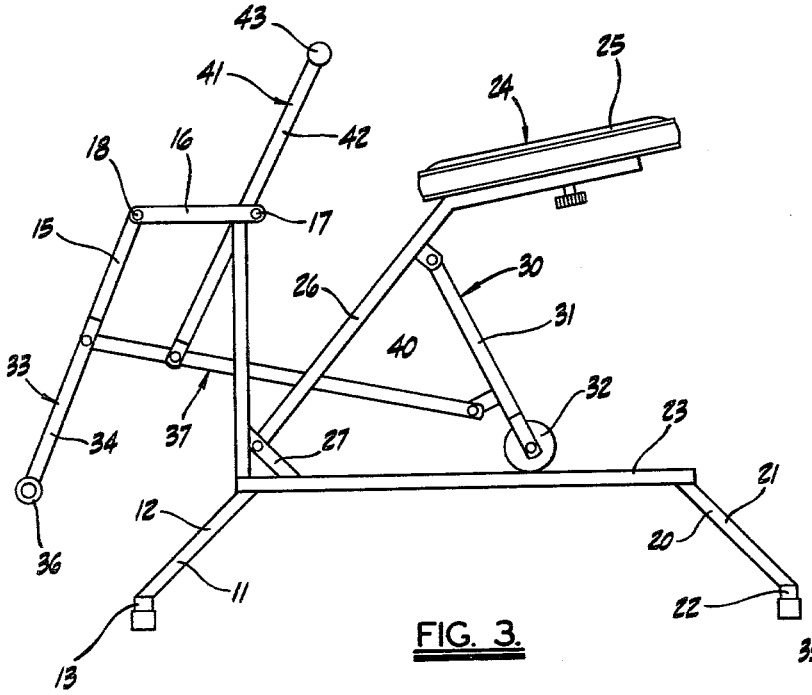
FIG. 3 is a side elevational view, similar to FIG. 2, but showing the seat in its raised position.
Figure 4:
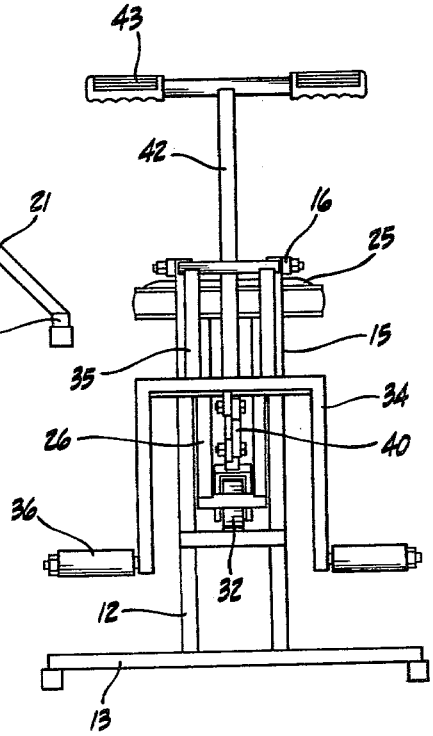
FIG. 4 is a front elevational view.

The user then pushes with his feet on the foot-engaging members 36, and simultaneously pulls with his hands on the handgrip members 43 so as to pivot respectively the bracket 34 on cross bar 18 and to pivot and slide the handle bar 42 on the cross bar 17. This pivotal action of the bracket 34 and the combined pivotal and sliding action of the handle bar 42 pulls the linkage bar 40 forwardly, and consequently pivots the seat-support arm 31. As the seat-support arm 31 is pivoted, the wheel 32 rollably engages and moves forward on the track 23 to raise the seat 25, all against the resistance of the user's weight on the seat 25. The raised position of the seat 25 and the resultant disposition of the component parts is illustrated in FIG. 3.

The weight of the user on the seat 25 tends to lower the seat 25 back to its lowered position. Consequently, the user must exert force on the bracket 34 through his legs and on the handle bar 42 through his arms to resist this load sufficiently so that the seat 25 will be lowered gradually from its raised position illustrated in FIG. 3 to its lowered position illustrated in FIG. 2. Otherwise, the seat 25 would fall abruptly to the lowered position. It will be understood that the user is exerting an effort through both his legs and his arms to overcome the load created by his own weight on the seat 25, both in raising and lowering the seat 25.

I claim as my invention:

1. An exercise device, comprising:

(a) a frame means including a floor-engaging front portion, and an upper front portion having a bearing bar, (b) a seat means including:

(1) a seat rearwardly of the upper frame portion, and (2) a seat frame extending forwardly of the seat and pivotally connected to the frame means, (c) a seat-support means including:

(1) an arm pivotally mounted to the seat frame, and extending downwardly and rearwardly, and (2) a follower on the arm pivotally engaging a subjacent surface, (d) a leg-actuated means pivotally connected to the upper front frame portion, and extending downwardly, the leg-actuated means including a pair of foot-engaging members, (e) linkage means pivotally connected to the leg-actuated means and pivotally connected to the seat-support arm, and (f) arm-actuated means including a handle bar pivotally connected to the linkage means between the pivotal connections of the linkage means with the leg-actuated means and the seat-support arm, and both pivotally and slidably engaging the bearing bar of the upper front frame portion for moving the handle bar upwardly and downwardly relative to the bearing bar to accommodate the movement of the linkage means, (g) the arm-actuated means and the leg-actuated means being pulled and pushed respectively by the arms and legs of a user sitting on the seat to pivot the seat-support arm and move the follower forwardly on the subjacent surface, and thereby raise the seat means against the weight of the user, the user's weight tending to move the seat-support follower rearwardly on the subjacent surface and thereby lower the seat means.

* * * * *